United States Patent [19]

Glen

[11] Patent Number: 4,840,752

[45] Date of Patent: Jun. 20, 1989

[54] CARBURETTOR

[75] Inventor: Robert D. Glen, Forest Hill, Great Britain

[73] Assignee: E.P. Barrus Limited, Oxfordshire, United Kingdom

[21] Appl. No.: 260,736

[22] Filed: Oct. 21, 1988

[30] Foreign Application Priority Data

Oct. 21, 1987 [GB] United Kingdom ..... 8724612

[51] Int. Cl.[4] ..... F02M 5/02

[52] U.S. Cl. ..... 261/72.1; 261/72.2; 261/DIG. 2

[58] Field of Search ..... 261/72.1, 72.2, DIG. 2

[56] References Cited

U.S. PATENT DOCUMENTS

| | | | |
|---|---|---|---|
| 1,912,842 | 6/1933 | Hobbs | 261/72.2 |
| 2,109,179 | 2/1938 | Michael | 261/72.1 |
| 2,130,884 | 9/1938 | Lafitte et al. | 261/72.2 |
| 2,264,365 | 12/1941 | Conover | 261/71 |
| 2,489,494 | 11/1949 | Martin | 261/72.1 |
| 4,040,399 | 8/1977 | Meininger | 261/72.1 |
| 4,461,250 | 7/1984 | Mohr | 261/72.1 |

*Primary Examiner*—Tim Miles

*Attorney, Agent, or Firm*—Raymond J. Lillie

[57] ABSTRACT

A carburettor for a motor on a marine craft, with lower part 1 holding fuel 2 is provided with flexible piping 12 communicating at each end with openings 13, 14 both in the said lower part. The piping 12 preferably has an enlarged intermediate portion 16. If the carburettor is inverted e.g. upon vessel capsize, the fuel 2 drains into the piping 12/16, which is dimensioned to hold the fuel so that, when the vessel is righted the fuel drains back into the lower portion 1 without detrimental loss of contamination.

5 Claims, 1 Drawing Sheet

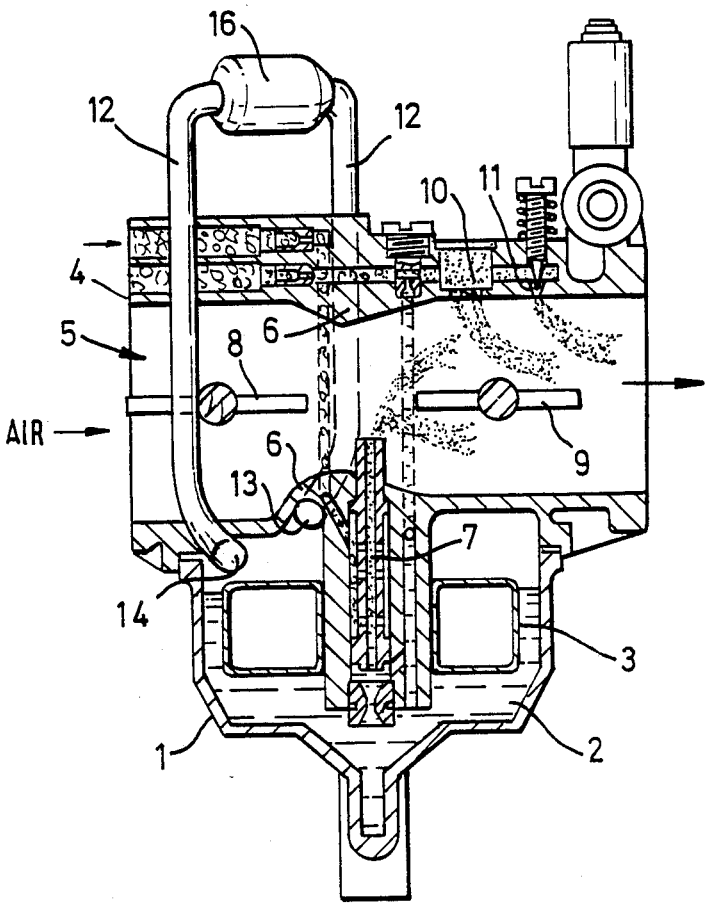
16
12
12
10
11
4
5
6
8
AIR
6
13
9
7
14
3
1
2

CARBURETTOR

This invention relates to carburettors, and especially those carburettors useful for marine or like motors in which inversion, e.g. upon capsizing, can be an occasional problem.

If version of an engine should take place, various components can be affected, and especially those holding on a temporary or permanent basis liquid fuel.

A major instance of such a component is the carburettor, which is an article made to high precision and holding its own temporary supply of fuel for vapourization and incorporation into an air stream as feed to the cylinders.

If such a carburettor is inverted, liquid fuel passes out from the normally lower part of the carburettor, through various passages and thence into the main body and elsewhere throughout the engine. If the inverted engine is then restored to its normal position, only such fuel as may not have drained away from its location in the carburettor is available straight away for restarting the engine. Refilling of the carburettor is therefore necessary. However, under many operating conditions, especially in the type of heavy sea in which capsize can take place, it is not convenient or practical to have to refill the carburettor before restarting.

We have therefore designed an expedient by which a capsized motor, once righted, can be again restarted with a carburettor appropriately full of fuel even after such capsize.

In one aspect the invention consists in a carburettor, especially suitable for marine motors, of the type in which a supply of liquid fuel is held in a generally closed lower portion of a carburettor body, the lower portion being provided with inlets for air and outlets for fuel whereby fuel held therein is displaced in disseminated or vaporous form, into a main engine air supply passing through the upper part of the carburettor: in which an elongate duct means of capacity generally equivalent to said supply of liquid fuel is provided to communicate at each end with the said lower portion so that when the carburettor is inverted the said supply of liquid fuel drains into the duct means under gravity, for re-use after like gravity drainage back into the lower portion when the carburettor is restored to its original orientation.

Preferably, the duct means has an expanded portion intermediate its ends, for example at about the middle, defining a chamber to contain liquid fuel.

The duct means can be constituted as a length of piping, for example, fabricated in synthetic polymeric material.

The invention, while having as one aspect the carburettor as defined above also includes within its scope an internal combustion engine, more especially suitable for marine use, including at least one such carburettor.

The invention will be further described with reference to the accompanying drawing, which is a vertical longitudinal section through a carburettor equipped with the additional ducting according to the invention.

The carburettor shown is of a generally conventional construction, and consists of a lower part 1 for holding a temporary supply of fuel 2 in a manner controlled by a float 3 and a suitable inlet valve (not shown). The carburettor also possesses an upper part 4 which is essentially defines a through-channel 5 with restricted central section 6 e.g. of a "venturi" type. Thus, passage of air through the upper part of the carburettor draws liquid fuel from 2 up a central bore 7 as a main jet of fuel for vapourisation in the air intake. Main bore valves 8, throttle valves 9, and ancillary fuel inlets 10 and 11 for purposes such as idling (when the throttle is turned off) or rapid acceleration (when the throtttle is rapidly turned on) are also provided. They are generally conventional and form no part of the present invention as such.

In accordance with the present invention a length of flexible piping 12 extends from an opening 13 in the upper region of the fuel-containing lower part of the carburettor, upwards and thence down again to rejoin the carburettor at opening 14, again in the upper region of the lower part of the carburettor and above the level of the liquid fuel. If desired, and as shown in dotted lines, the central part of this ducting can be enlarged as at 16.

The details of disposition of this piping, and of its construction and shape, can vary. In normal use of the engine, the piping is of no effect, whether advantageous or adverse. If, however, the engine should become inverted on a capsize the liquid fuel 2 drains into the piping 12 instead of draining away through the various small vents shown. The piping 12 should of course be of a suitable volume to permit this, and the use of an enlarged portion 16, of suitable design, may facilitate such drainage.

When the capsized engine is again placed in its corect orientaiton, the fuel in the pipe drains back into the carburettor in substantially the same amount and without contamination.

It will be found helpful if the apertures 13, 14 by which the ducting 12 communicates to the lower portion of the carburettor are larger than the various small communication.

I claim:

1. A carburettor, especially suitable for marine motors, of the type in which a supply of liquid fuel is held in a generally closed lower portion of a carburettor body, the lower portion being provided with inlets for air and outlets for fuel whereby fuel held therein is displaced in disseminated or vaporous form, into a main engine air supply passing through the upper part of the carburettor: in which an elongate duct means of capacity generally equivalent to said supply of liquid fuel is provided to communicate at each end with the said lower portion so that when the carburettor is inverted the said supply of liquid fuel drains into duct means under gravity, for re-use after like gravity drainage back into the lower portion when the carburettor is restored to its original orientation.

2. A carburettor as claimed in claim 1 which the duct means has an expanded portion intermediate its ends defining a chamber to contact liquid fuel.

3. A carburettor as claimed in claim 1 or 2 constructed as a single length of piping.

4. A carburettor as claimed in claim1 or 2 constituted as a length of synthetic polymeric piping.

5. An internal combustion engine comprising a carburettor as claim in claim 1 or 2.

* * * * *